US011254896B2

(12) United States Patent
Kuppert et al.

(10) Patent No.: US 11,254,896 B2
(45) Date of Patent: Feb. 22, 2022

(54) GRANULATE COMPRISING AN INORGANIC SOLID CARRIER WITH AT LEAST ONE BIOSURFACTANT CONTAINED THEREON

(71) Applicant: Evonik Operations GmbH, Essen (DE)

(72) Inventors: Dirk Kuppert, Frankfurt (DE); Rudolf Egner, Steinau (DE); Jürgen Lattich, Nidderau-Ostheim (DE); Jens Hildebrand, Johannesberg (DE)

(73) Assignee: Evonik Operations GmbH, Essen (DE)

( * ) Notice: Subject to any disclaimer, the term of this patent is extended or adjusted under 35 U.S.C. 154(b) by 6 days.

(21) Appl. No.: 16/077,556

(22) PCT Filed: Mar. 1, 2017

(86) PCT No.: PCT/EP2017/054724
§ 371 (c)(1),
(2) Date: Aug. 13, 2018

(87) PCT Pub. No.: WO2017/157659
PCT Pub. Date: Sep. 21, 2017

(65) Prior Publication Data

US 2019/0031977 A1 Jan. 31, 2019

(30) Foreign Application Priority Data

Mar. 18, 2016 (EP) ..... 16161078

(51) Int. Cl.

| | |
|---|---|
| ***C11D 17/06*** | (2006.01) |
| ***C11D 1/66*** | (2006.01) |
| ***C11D 3/08*** | (2006.01) |
| ***C11D 3/10*** | (2006.01) |
| ***C11D 3/12*** | (2006.01) |
| ***C11D 3/39*** | (2006.01) |
| ***C11D 3/00*** | (2006.01) |
| ***C11D 11/00*** | (2006.01) |
| ***C11D 1/06*** | (2006.01) |
| ***C11D 17/00*** | (2006.01) |

(52) U.S. Cl.

CPC ..... *C11D 1/662* (2013.01); *C11D 1/06* (2013.01); *C11D 3/0026* (2013.01); *C11D 3/10* (2013.01); *C11D 3/124* (2013.01); *C11D 3/128* (2013.01); *C11D 3/1246* (2013.01); *C11D 3/3942* (2013.01); *C11D 11/0023* (2013.01); *C11D 17/0034* (2013.01); *C11D 17/06* (2013.01)

(58) Field of Classification Search

None

See application file for complete search history.

(56) References Cited

U.S. PATENT DOCUMENTS

| | | | | |
|---|---|---|---|---|
| 7,241,433 | B2 | 7/2007 | Jakob et al. | |
| 7,588,697 | B2 | 9/2009 | Zimmermann et al. | |
| 9,243,212 | B2 | 1/2016 | Kuppert et al. | |
| 2004/0171512 | A1* | 9/2004 | Furuta | C11D 1/662 510/470 |
| 2004/0224873 | A1* | 11/2004 | Raehse | B01D 1/18 510/446 |
| 2013/0072414 | A1 | 3/2013 | Price et al. | |
| 2014/0194336 | A1* | 7/2014 | Develter | C12P 7/6436 510/218 |
| 2016/0186099 | A1* | 6/2016 | Geny | C11D 11/0082 510/445 |
| 2017/0073621 | A1* | 3/2017 | Schelges | C11D 17/0047 |
| 2017/0306264 | A1* | 10/2017 | Peggau | C11D 1/83 |
| 2018/0023040 | A1* | 1/2018 | Schilling | C11D 3/386 510/392 |

FOREIGN PATENT DOCUMENTS

| | | | |
|---|---|---|---|
| DE | 19851454 | A1 | 5/2000 |
| DE | 102009027158 | A1 | 12/2010 |
| DE | 102010063625 | A1 | 6/2012 |
| DE | 102014212642 | A1 | 12/2015 |
| EP | 0799884 | A2 | 10/1997 |
| EP | 1411111 | A1 | 4/2004 |
| JP | 2006274233 | A | 10/2006 |
| JP | 2009052006 | A | 3/2009 |
| JP | 2009091534 | A | 4/2009 |
| WO | 2010063689 | A1 | 6/2010 |
| WO | 2017157659 | A1 | 9/2017 |

* cited by examiner

*Primary Examiner* — Lorna M Douyon

(74) *Attorney, Agent, or Firm* — Taylor English Duma LLP; Philip P. McCann

(57) ABSTRACT

The invention relates to a granulate comprising an inorganic solid carrier with at least one biosurfactant contained thereon, as well as to formulations containing this granulate and to the use of same.

17 Claims, No Drawings

GRANULATE COMPRISING AN INORGANIC SOLID CARRIER WITH AT LEAST ONE BIOSURFACTANT CONTAINED THEREON

CROSS REFERENCE TO RELATED APPLICATIONS

This application is a 35 U.S.C. § 371 U.S. national phase entry of International Application No. PCT/EP2017/054724 having an international filing date of Mar. 1, 2017, which claims the benefit of European Application No. 16161078.7 filed Mar. 18, 2016, each of which is incorporated herein by reference in its entirety.

FIELD

The invention provides a granular material comprising an inorganic solid support on which at least one biosurfactant is present, formulations comprising this granular material and the use thereof.

BACKGROUND

The problem addressed by the present invention, then, is that of providing a cleaning composition for hard surfaces which removes persistent stains, especially starchy stains. More particularly, the problem addressed is that of providing a cleaning composition for dishware, especially that of providing of a cleaning composition for machine cleaning of dishware.

SUMMARY

It has been found that, surprisingly, the granular material described hereinafter, comprising an inorganic solid support on which at least one biosurfactant is present, is capable of solving the problem addressed by the invention.

DETAILED DESCRIPTION

The present invention therefore provides a granular material comprising an inorganic solid support on which at least one biosurfactant selected from the group comprising, preferably consisting of, sophorolipids and rhamnolipids, especially sophorolipids, is present, characterized in that the support comprises at least one solid material selected from the group comprising carbonates, sesquicarbonates, percarbonates, perborates, sulphates, silicates, aluminosilicates, zeolites, precipitated silicas and fumed silicas.

The invention further provides a process for producing granular materials comprising an inorganic support on which at least one biosurfactant is present, formulations comprising the granular materials according to the invention, and the use of the formulations.

One advantage of the present invention is that persistent, dried-on stains are removed very efficiently at low ambient temperatures.

Another advantage of the present invention is that the formulations remove starchy soiling without needing to use enzymes.

A further advantage of the present invention is that granular materials can be defoamed in an excellent manner with small amounts of defoamer.

The granular materials according to the invention and uses thereof are described below by way of example without any intention of limiting the invention to these illustrative embodiments. When ranges, general formulae or compound classes are specified hereinbelow, these shall encompass not just the corresponding ranges or groups of compounds that are explicitly mentioned but also all subranges and subgroups of compounds obtainable by extracting individual values (ranges) or compounds. Where documents are cited in the context of the present description, their content shall fully form part of the disclosure content of the present invention, particularly in respect of the matters referred to. Where mean values are stated hereinbelow, unless stated otherwise, these are number-averaged mean values. Unless stated otherwise, percentages are data in percent by weight. Wherever measurement values are stated hereinbelow, then, unless stated otherwise, these have been determined at a temperature of 25° C. and a pressure of 1013 mbar.

The term "carbonates" in connection with the present invention does not include hydrogencarbonates.

The term "sophorolipids" is understood in connection with the present invention to mean sophorolipids as reflected in the general formulae (Ia) and (Ib) of EP2501813.

The term "rhamnolipids" is understood in connection with the present invention to mean rhamnolipids as reflected in the general formula (I) of EP2598646.

Preference is given in accordance with the invention to a granular material which is characterized in that the carbonates, sesquicarbonates, percarbonates, perborates and sulphates are salts of the alkali metals or alkaline earth metals, especially the alkali metals. In a particularly preferred embodiment, the granular material is characterized in that the at least one solid material is selected from sodium carbonate, sodium percarbonate, fumed and precipitated silicas, especially in combination with a sophorolipid as biosurfactant present on the support.

In a very particularly preferred embodiment, the granular material is characterized in that the at least one solid material is selected from fumed and precipitated silicas in combination with a sophorolipid as biosurfactant present on the support.

Suitable precipitated silicas are sold, for example, by Evonik Industries as Sipernat®, for example Sipernat 22, and suitable fumed silicas as Aerosil®.

It is preferable in accordance with the invention when the granular materials according to the invention comprise an inorganic solid support containing the aforementioned solid materials in an amount of 40% by weight to 100% by weight, preferably of 50% by weight to 90% by weight, more preferably of 60% by weight to 80% by weight, where the percentages by weight are based on the overall support.

According to the invention, sophorolipids may be present in the granular materials of the invention in their acid form or their lactone form. With regard to the term "acid form" of sophorolipids reference is made to the general formula (Ia) of EP2501813, and with regard to the term "lactone form" of sophorolipids reference is made to the general formula (Ib) of EP2501813.

Granular materials preferred in accordance with the invention are characterized in that the biosurfactant present on the support is a sophorolipid, in which the weight ratio of lactone form to the acid form is within a range from 20:80 to 80:20, preferably from 30:70 to 40:60.

With regard to determination of the content of sophorolipids in the acid or lactone form in a formulation, reference is made to EP1411111 B1, page 8, paragraph [0053].

The biosurfactant present on the support is present in the granular material of the invention preferably in an amount of 0.01% by weight to 70% by weight, preferably of 0.25% by weight to 60% by weight, more preferably of 1.5% by weight to 50% by weight, where the percentages by weight are based on the sum total of the weights of biosurfactant and support.

The granular material of the invention advantageously has a median particle size d50 [μm] in the range from 100 to 2000 μm, particularly in the range from 200 to 1500 μm and especially in the range from 700 to 1300 μm. By definition, the d50 [μm] value marks the point at which half the volume of particles examined is greater and half is smaller. In addition, the d10 and the d90 values state the range in which, respectively, 10% and 90% are less than or equal to this particle size. The median particle size d50 [μm], and also the d10 [μm] and the d90 [μm] value of the particle collective are ascertained here with the aid of a Camsizer® from Retsch (Haan, Germany) via the method of dynamic image analysis with choice of standard settings (ISO 13322-2: 2006). The measurement method employed gives a detailed particle size analysis of the overall particle collective, which is shown as a distribution density function. In the distribution density function, the d50 value is taken to be the abscissa value of the greatest maximum.

Preferably, particle collectives of a narrow particle size distribution are to be selected. These are characterized in that the d10 [μm] value of the particle collective is not less than 50% and the d90 [μm] is not greater than 150% of the median particle size d50 [μm].

It is preferable in accordance with the invention when the granular material additionally comprises at least one defoamer.

Examples of useful defoamers include a wide variety of different oils, such as organopolysiloxanes, for example in the form of silicone oils or polyoxyalkylene-polysiloxane block copolymers, polyethers, vegetable or animal oils, paraffins or mineral oils. At the same time, finely divided solids which boost the defoaming action may be present in the oils. An example of such a finely divided solid is finely divided silica obtained by pyrolytic or wet-chemical means, which is commercially available as Aerosil or Sipernat, and can be hydrophobized by treatment with organosilicon compounds. Further suitable solids are metal soaps such as magnesium soaps, aluminium soaps and calcium soaps, and also polyethylene waxes and the amide waxes.

Defoamers present with preference in accordance with the invention are selected from the group consisting of vegetable oils, especially colza oil and rapeseed oil, silicone oils, hydrophobized silica, paraffins, paraffin-alcohol combinations, bis-fatty acid amides, polyorganosiloxanes and mixtures thereof.

Polyorganosiloxanes present with preference as defoamers are selected from the group consisting of the high-viscosity, high molecular weight organopolysiloxane compounds that are used in aqueous emulsions and are specified in US2004198842, the aminosiloxanes specified as defoamers in EP0579999, the organopolysiloxanes of the general formula I that are specified in U.S. Pat. No. 6,001,887, and Further defoamers present with preference in accordance with the invention are the alkoxylated partial esters of oligoglycerols with C8 to C22 fatty acids that are described in U.S. Pat. No. 5,994,415, where 3 to 60 mol of propylene oxide and optionally 1 to 10 mol of styrene oxide and/or 1 to 10 mol of butylene oxide are used.

It is preferable in accordance with the invention when the granular material contains the at least one defoamer in an amount of 0.001% by weight to 5% by weight, preferably from 0.01% by weight to 2% by weight, more preferably from 0.05% by weight 0.5% by weight, where the percentages by weight are based on the sum total of the weights of biosurfactant, defoamer and support.

The invention further provides a process for producing a granular material, comprising the process steps of A) providing a solid particulate inorganic support, B) providing at least one biosurfactant selected from the group comprising sophorolipids and rhamnolipids in the form of an aqueous composition which is liquid at 25° C. and 1 bar, C) contacting the support from process step A) with the aqueous composition from process step B) and D) at least partly removing the water originating from the aqueous composition from process step B).

The solid particulate organic supports provided in process step A) are preferably selected from the inorganic solid supports encompassed within the granular materials according to the invention.

The biosurfactants provided in process step B) are preferably selected from sophorolipids, especially from those that are preferably present in the granular materials according to the invention in terms of the acid to lactone ratio.

The aqueous composition from process step B) preferably includes water in an amount of 10% to 90% by weight, preferably of 20% to 70% by weight, more preferably of 30% to 60% by weight, where the percentages by weight are based on the overall aqueous composition.

The aqueous composition from process step B) preferably includes the biosurfactant in an amount of 10% to 90% by weight, preferably of 30% to 80% by weight, more preferably of 40% to 70% by weight, where the percentages by weight are based on the overall aqueous composition.

It is preferable in accordance with the invention when, in process step B), a defoamer, preferably one of those mentioned above as preferred in the granular material in accordance with the invention, is additionally present in the aqueous composition.

It is preferable in accordance with the invention when, in process step C), the contacting is effected by spraying the aqueous composition from process step B) onto the support from process step A).

The contacting by spray application can be effected, for example, with the aid of a fluidized bed spray granulator or a ploughshare mixer.

In the case of use of a fluidized bed spray granulator, the inorganic support is fluidized and kept in constant motion by the inflow of a suitable gas, for example air, nitrogen or carbon dioxide.

It is preferable in accordance with the invention that, in the case of use of a fluidized bed spray granulator, process step C) is conducted at a temperature of 30° C. to 100° C., preferably of 40° C. to 80° C. and most preferably of 50° C. to 60° C.

In the case of use of a fluidized bed spray granulator, this is achieved by choosing and regulating the temperature of the inflowing gas such that the fluidized support, during the contacting of the fluidized support with the aqueous composition of the biosurfactant, has a temperature of 30° C. to 100° C., preferably of 40° C. to 80° C. and most preferably of 50° C. to 60° C. The contacting of the biosurfactant with the fluidized support is effected by spray application, which can be conducted by the top-spraying, bottom-spraying or tangential spraying method, more preferably by the top-spraying method.

The coating in the fluidized bed can be effected batchwise or else, in the case of a continuous throughput, in continuous fluidized bed systems.

In the case of use of a ploughshare mixer, in process step C), the inorganic support is coated with aqueous composition from process step B) with the aid of the spinning and swirling method. The aqueous composition from process step B) is introduced into a mechanically generated fluidized bed of the inorganic support by spray application. It is preferable in accordance with the invention that, in the case of use of a ploughshare mixer, process step C) is conducted at a temperature of 15° C. to 30° C., more preferably of 20° C. to 25° C. The coating in the case of use of a ploughshare mixer can be effected batchwise or else, in the case of a continuous throughput, in continuous systems.

In process step D), the at least partial removal of the water is preferably achieved by heating.

It is preferable in accordance with the invention that process step D) is conducted at a temperature of 50° C. to 120° C., preferably of 60° C. to 100° C. and most preferably of 70° C. to 80° C. In general, the drying could also be effected at room temperature (20-25° C.).

In the case of use of a fluidized bed spray granulator, this is achieved by choosing and regulating the temperature of the inflowing gas in process step D) such that it is within the range from 50° C. to 120° C., preferably from 60° C. to 100° C. and most preferably from 70° C. to 80° C.

The present invention further provides a granular material obtainable by the process according to the invention.

The present invention still further provides a formulation comprising a granular material according to the invention or a granular material obtainable by the process according to the invention, which is characterized in that the formulation contains from 0.1% by weight to 60% by weight, preferably from 1% by weight to 50% by weight, more preferably from 2% by weight to 40% by weight, of the aforementioned granular material, where the percentages by weight are based on the overall formulation.

A formulation preferred in accordance with the invention is characterized in that the formulation is a cleaning composition for hard surfaces, especially a dishwashing detergent and most preferably a dishwashing detergent for machine cleaning of dishware. Dishwashing detergents for machine cleaning of dishware nowadays frequently take the form of tablets. These are pulverulent cleaning compositions which have been converted to a particular shape by means of pressure. The use of tablets enables the dosage of active substances in the cleaning composition appropriately for a cleaning cycle. Alternatively, a cleaning composition for machine dishwashers may take the form of a powder.

The formulations according to the invention are preferably a solid dishwashing detergent. A "solid dishwashing detergent" is understood to mean a dishwashing detergent which is in the solid state of matter at 25° C. and a pressure of 1 bar. In a preferred embodiment, the solid dishwashing detergent is in the form of a shaped body, especially a compact, particularly a tablet.

It is preferable in accordance with the invention that the formulation comprises at least one further constituent, preferably at least two further constituents, selected from the group consisting of builders, surfactants, polymers, corrosion inhibitors, especially glass corrosion inhibitors, disintegration aids, enzymes, bleaches, bleach catalysts, bleach activators, fragrances and perfume carriers.

The formulations according to the invention preferably additionally comprise at least one further surfactant in addition to the granular material according to the invention. This surfactant is selected from the group of the anionic, nonionic, cationic and amphoteric surfactants, more preferably from the group of the nonionic surfactants. The formulations according to the invention may also comprise mixtures of two or more surfactants selected from the same group.

Nonionic surfactants used may be any nonionic surfactants known to the person skilled in the art. Suitable nonionic surfactants are, for example, alkylglycosides of the general formula RO(G)x in which R corresponds to a primary straight-chain or methyl-branched, especially 2-methyl-branched, aliphatic radical having 8 to 22 and preferably 12 to 18 carbon atoms, and G is the symbol that represents a glycose unit having 5 or 6 carbon atoms, preferably glucose. The oligomerization level x, which states the distribution of monoglycosides and oligoglycosides, is any number from 1 to 10; x is preferably 1.2 to 1.4.

A further class of usable nonionic surfactants which can be used either as the sole nonionic surfactant or in combination with other nonionic surfactants is that of alkoxylated, preferably ethoxylated or ethoxylated and propoxylated, fatty acid alkyl esters, preferably having 1 to 4 carbon atoms in the alkyl chain.

Other suitable nonionic surfactants may be those of the amine oxide type, for example N-cocoalkyl-N,N-dimethylamine oxide and N-tallowalkyl-N,N-dihydroxyethylamine oxide, and of the fatty acid alkanolamide type. The amount of these nonionic surfactants is preferably not more than that of the ethoxylated fatty alcohols, especially not more than half thereof.

Further suitable surfactants are polyhydroxy fatty acid amides as described, for example, in DE 10 2014 212 622 paragraph [0026]-[0027].

Preferred nonionic surfactants used are low-foaming nonionic surfactants. With particular preference, the formulations according to the invention comprise nonionic surfactants from the group of the alkoxylated alcohols.

Nonionic surfactants used are preferably alkoxylated, advantageously ethoxylated, especially primary alcohols having preferably 8 to 18 carbon atoms and an average of 1 to 12 mol of ethylene oxide (EO) per mole of alcohol, in which the alcohol radical may be linear or preferably 2-methyl-branched or may contain linear and methyl-branched radicals in a mixture, as typically present in oxo process alcohol radicals. More particularly, however, preference is given to alcohol ethoxylates with linear radicals from alcohols of native origin having 12 to 18 carbon atoms, for example from coconut alcohol, palm alcohol, tallow fat alcohol or oleyl alcohol, and an average of 2 to 8 EO per mole of alcohol. The preferred ethoxylated alcohols include, for example, C12-14 alcohols with 3 EO or 4 EO, C8-C11 alcohol with 7 EO, C13-C15 alcohols with 3 EO, 5 EO, 7 EO or 8 EO, C12-18 alcohols with 3 EO, 5 EO or 7 EO and mixtures of these, such as mixtures of C12-14 alcohol with 3 EO and C12-18-alcohol with 5 EO. The stated degrees of ethoxylation are statistical average values which may correspond to an integer or a fraction for a specific product. Preferred alcohol ethoxylates have a narrow homologue distribution (narrow range ethoxylates, NRE). In addition to these nonionic surfactants, it is also possible to use fatty alcohols with more than 12 EO. Examples thereof are tallow fat alcohol with 14 EO, 25 EO, 30 EO or 40 EO.

Especially preferred are nonionic surfactants having a melting point above room temperature. Nonionic surfactant(s) having a melting point above 20° C., preferably above 25° C., more preferably between 25 and 60° C. and especially between 26.6 and 43.3° C. is/are particularly preferred.

Surfactants for use with preference come from the groups of the alkoxylated nonionic surfactants, especially the ethoxylated primary alcohols and mixtures of these surfactants with surfactants of complex structure, such as polyoxypropylene/polyoxyethylene/polyoxypropylene (PO/EO/PO) surfactants. Such (PO/EO/PO) nonionic surfactants are additionally notable for good foam control.

Additionally usable are nonionic surfactants as disclosed in DE 1020142012622 in paragraphs [0036]-[0059].

It is of course possible to use the aforementioned nonionic surfactants not just as individual substances but also as surfactant mixtures of two, three, four or more surfactants. The proportion by weight of the nonionic surfactant in the total weight of the formulation according to the invention, in a preferred embodiment, is from 0.1% to 20% by weight, more preferably from 0.5% to 15% by weight, especially from 2.5% to 10% by weight. Anionic surfactants may likewise be used as a constituent of machine dishwashing detergents. These especially include alkylbenzenesulphonates, fatty alkyl sulphates, fatty alcohol ether sulphates and alkanesulphonates. The proportion in the compositions of anionic surfactants is typically 0% to 10% by weight. Preferred formulations are further characterized in that they contain less than 1.0% by weight of and especially no anionic surfactant, since the addition of anionic surfactants has been found to be disadvantageous with regard to the tablet (phase) properties, especially the hardness, friability and subsequent hardening characteristics thereof.

Instead of the surfactants mentioned or in conjunction therewith, it is also possible to use cationic and/or amphoteric surfactants.

Cationic surfactants used may, for example, be cationic compounds of the following formulae:

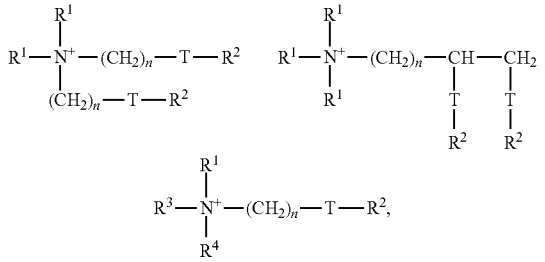

in which each $R_1$ group is independently selected from $C_{1-6}$-alkyl, -alkenyl or -hydroxyalkyl groups; each $R_2$ group is independently selected from $C_{8-28}$-alkyl or -alkenyl groups; $R_3$=$R_1$ or $(CH_2)_n$-T-$R_2$; $R_4$=$R_1$ or $R_2$ or $(CH_2)_n$-T-$R_2$; T=—$CH_2$—, —O—CO— or —CO—O— and n is an integer from 0 to 5.

Amphoteric surfactants are understood to mean surface-active compounds which bear at least one quaternary ammonium group and at least one —$COO^-$ or —$SO_3^-$ group in the molecule. Particularly preferred amphoteric surfactants in this connection are betaine surfactants such as alkyl- or alkylamidopropylbetaines. Especially preferred here are betaines such as the N-alkyl-N,N-dimethylammonium glycinates, e.g. cocoalkyldimethylammonium glycinate, N-acylaminopropyl-N,N-dimethylammonium glycinates, e.g. cocoacylaminopropyldimethylammonium glycinate, C12-C18-alkyldimethylacetobetaine, cocoamidopropyldimethylacetobetaine, 2-alkyl-3-carboxymethyl-3-hydroxyethylimidazolines and sulfobetaines each having 8 to 18 carbon atoms in the alkyl or acyl group, and cocoacylaminoethyl hydroxyethyl carboxymethylglycinate. A particularly preferred zwitterionic surfactant is N,N-dimethyl-N-(lauroylamidopropyl)ammonium acetobetaine, known under the INCI name Cocamidopropyl Betaine.

Further suitable amphoteric surfactants are the group of amphoacetates and amphodiacetates, especially for example coco- or laurylamphoacetates or -diacetates, the group of the amphopropionates and amphodipropionates and the group of the amino acid-based surfactants such as acylglutamates, especially Disodium Cocoyl Glutamate and Sodium Cocoyl Glutamate, acyl glycinates, especially Cocoyl Glycinate, and acylsarcosinates, especially Ammonium Lauroyl Sarcosinate and Sodium Cocoyl Sarcosinate.

In machine dishwashing detergents according to the invention, the content of cationic and/or amphoteric surfactants is preferably less than 6% by weight, more preferably less than 4% by weight, even more preferably less than 2% by weight and especially less than 1% by weight, based on the overall composition. Machine dishwashing detergents according to the invention that contain only nonionic surfactants are very particularly preferred, especially in combination with a sophorolipid as biosurfactant present on the support.

In addition, the formulations according to the invention may comprise at least one enzyme or at least one enzyme preparation or enzyme composition consisting of one or more enzymes. Suitable enzymes include, but are not limited to, proteases, amylases, lipases, cellulases, hemicellulases, mannanases, pectin-cleaving enzymes, tannases, xylanases, xanthanases, β-glucosidases, carrageenases, perhydrolases, oxidases, oxidoreductases and mixtures thereof. These enzymes are of natural origin in principle; proceeding from the natural molecules, improved variants are available for use in cleaning compositions, and these are used with corresponding preference. Formulations according to the invention may contain enzymes and/or enzyme preparation(s), preferably in total amounts of 0.01% to 20% by weight, further preferably of 0.1% to 15.0% by weight, even further preferably of 0.2% to 10% by weight and most preferably of 0.4% to 8.0% by weight, based on the overall formulation.

The use of builders such as silicates, aluminosilicates (especially zeolites), salts of organic di- and polycarboxylic acid and mixtures of these substances, preferably of water-soluble builders, may be advantageous. Organic builders which may be present in the formulations according to the invention are, for example, the polycarboxylic acids usable in the form of their sodium salts, polycarboxylic acids being understood to mean those carboxylic acids which bear more than one acid function. For example, these are citric acid, adipic acid, succinic acid, glutaric acid, malic acid, tartaric acid, maleic acid, fumaric acid, sugar acids, aminocarboxylic acids, nitrilotriacetic acid (NTA), methylglycinediacetic acid (MGDA), polyaspartic acid sodium salt, ethylenediaminetriacetate cocoalkylacetamide (for example Rewopol® CHT 12 from Evonik Industries AG, Essen (Germany)) and derivatives thereof and mixtures of these.

Preferred salts are the salts of the polycarboxylic acids such as citric acid, adipic acid, succinic acid, glutaric acid, tartaric acid, sugar acids and mixtures of these. Particularly preferred formulations according to the invention contain, as one of their essential builders, one or more salts of citric acid, i.e. citrates. These are preferably present in a proportion of 2% to 50% by weight, especially of 5% to 40% by weight, particularly of 10% to 40% by weight, based on the total weight of the dishwashing detergent of 100% by weight. Citrates are preferably used in combination with carbonates and/or hydrogencarbonates. Particular preference is given to the use of carbonate(s) and/or hydrogencarbonate(s), preferably alkali metal carbonate(s), more preferably sodium carbonate, in amounts of 2% to 30% by weight, preferably of 4% to 25% by weight and especially of 8% to 25% by weight, based in each case on the weight of the machine dishwashing detergent. Preferred formulations are therefore characterized by a builder combination of citrate and carbonate and/or hydrogencarbonate.

It is also possible to use the commonly known phosphates as builders, unless such a use should be avoided for environmental reasons. Among the multitude of the commercially available phosphates, the alkali metal phosphates, with particular preference for pentasodium or pentapotassium triphosphate (sodium or potassium tripolyphosphate), have the greatest significance in the washing or cleaning products industry.

Alkali metal phosphates is the umbrella term for the alkali metal (especially sodium and potassium) salts of the various phosphoric acids, where a distinction can be drawn between metaphosphoric acids $(HPO_3)_n$ and orthophosphoric acid $H_3PO_4$ alongside higher molecular weight representatives. The phosphates combine several advantages in one: they act as alkali carriers, prevent scale deposits on machine parts or scale incrustation in fabrics, and additionally contribute to cleaning performance.

Phosphates that are of particular industrial importance are pentasodium triphosphate, $Na_5P_3O_{10}$ (sodium tripolyphosphate) and the corresponding potassium salt pentapotassium triphosphate, $K_5P_3O_{10}$ (potassium tripolyphosphate). The sodium potassium tripolyphosphates are usable with preference.

If, in the context of the present invention, phosphates are used as washing- or cleaning-active substances in the formulations, especially in machine dishwashing detergents, preferred compositions contain this phosphate/these phosphates, preferably alkali metal phosphate(s), more preferably pentasodium or pentapotassium triphosphate (sodium or potassium tripolyphosphate), in amounts of 5% to 80% by weight, preferably of 15% to 75% by weight and especially of 20% to 70% by weight, based in each case on the weight of the cleaning composition, preferably dishwashing detergent, especially machine dishwashing detergent. However, it is preferable that the cleaning compositions described herein are essentially free of phosphates, especially the aforementioned phosphates.

"Phosphate-free" as used herein means that the composition in question is essentially free of phosphates, i.e. especially phosphates in amounts of less than 0.1% by weight, preferably less than 0.01% by weight, based on the overall composition. If phosphates are present, they are preferably used in amounts corresponding to not more than 0.3 g/job. The expression g per job (g/job) or g/use means the amount of the active substance used in relation to the total weight of the composition used for a complete cleaning cycle (i.e., for machine dishwashing detergents, the total amount of the cleaning composition used in a complete cleaning program of a machine dishwasher). In the case of pre-portioned cleaning compositions (preferably machine dishwashing compositions), this figure is the amount of the active substance in g based on the total weight of the pre-portioned cleaning composition. The expression "phosphates" as used in this context does not include the phosphonates described below.

In addition, the formulations according to the invention may comprise at least one phosphorus-free builder, the further phosphorus-free builder preferably being selected from methylglycinediacetic acid (MGDA), glutamic acid diacetate (GLDA), aspartic acid diacetate (ASDA), hydroxyethyl iminoacetate (HEIDA), iminodisuccinate (IDS) and ethylenediaminedisuccinate (EDDS), more preferably from MGDA and GLDA, where the proportion by weight of the builders, based on the total weight of the cleaning composition, is preferably 5% to 80% by weight, preferably 10% to 75% by weight and especially 15% to 70% by weight.

The percentage by weight of the (hydrogen)carbonate and citrate here is preferably as specified above. The percentage by weight of the further phosphorus-free builder, especially of the MGDA and/or GLDA, is preferably 2% to 40% by weight, especially 5% to 30% by weight, in particular 7% to 20% by weight.

Suitable builders which may likewise be present in the formulations according to the invention are additionally polymeric polycarboxylates. These are, for example, the alkali metal salts of polyacrylic acid or of polymethacrylic acid, for example those having a relative molecular mass of 600 to 750 000 g/mol. Suitable polymers are especially polyacrylates preferably having a molecular mass of 1000 to 15 000 g/mol. Because of their superior solubility, from this group, the short-chain polyacrylates having molar masses of 1000 to 10 000 g/mol and more preferably of 1000 to 5000 g/mol may be preferable in turn.

Also suitable are copolymeric polycarboxylates, especially those of acrylic acid with methacrylic acid and of acrylic acid or methacrylic acid with maleic acid. To improve the water solubility, the polymers may also contain allylsulphonic acids, such as allyloxybenzenesulphonic acid and methallylsulphonic acid, as monomer.

The content of (homo)polymeric polycarboxylates is preferably 0% to 20% by weight and especially 0.5% to 10% by weight.

Formulations according to the invention may further comprise, as builder, crystalline sheet silicates of the general formula $NaMSi_xO_{2x}$+1.yH2O in which M represents sodium or hydrogen, x is a number from 1.9 to 22, preferably from 1.9 to 4, particularly preferred values of x being 2, 3 or 4, and y is a number from 0 to 33, preferably from 0 to 20. It is also possible to use amorphous sodium silicates having an $Na_2O:SiO_2$ modulus of 1:2 to 1:3.3, preferably of 1:2 to 1:2.8 and especially of 1:2 to 1:2.6, which preferably have retarded dissolution and secondary washing properties.

In preferred formulations according to the invention, the content of silicates, based on the total weight of the cleaning composition, is limited to amounts below 10% by weight, preferably below 5% by weight and especially below 3% by weight. Particularly preferred machine dishwashing detergents according to the invention are silicate-free.

In addition to the aforementioned builders, the formulations according to the invention may comprise alkali metal hydroxides. These alkali carriers are used in the formulations preferably only in small amounts, preferably in amounts below 10% by weight, more preferably below 6% by weight, preferably below 5% by weight, especially preferably between 0.1% and 5% by weight and especially between 0.5% and 5% by weight, based in each case on the total weight of the formulation. Alternative formulations are free of alkali metal hydroxides.

Formulations according to the invention may further comprise phosphonate(s) as builder. Phosphonates usable in accordance with the invention are preferably selected from aminotrimethylenephosphonic acid (ATMP); ethylenediaminetetra(methylenephosphonic acid) (EDTMP); diethylenetriaminepenta(methylenephosphonic acid) (DTPMP); 1-hydroxyethane-1,1-diphosphonic acid (HEDP); 2-phosphonobutane-1,2,4-tricarboxylic acid (PBTC); hexamethylenediaminetetra(methylenephosphonic acid)

(HDTMP) and nitrilotri(methylenephosphonic acid) (NTMP), particular preference being given to using 1-hydroxyethane-1,1-diphosphonic acid (HEDP) and diethylenetriaminepenta(methylenephosphonic acid) (DTPMP). Phosphonate(s) are used in formulations according to the invention preferably in amounts of 0% to 20% by weight, especially of 0.5% to 10% by weight and in particular of 0.5% to 8% by weight.

The group of the polymers especially includes the washing- or cleaning-active polymers, for example the rinse aid polymers and/or as softening polymers. In general, it is possible to use, in machine dishwashing detergents, not only nonionic polymers but also cationic, anionic and amphoteric polymers.

"Cationic polymers" in the context of the present invention are polymers that bear a positive charge in the polymer molecule. This can be accomplished, for example, by means of (alkyl)ammonium moieties or other positively charged groups present in the polymer chain. Particularly preferred cationic polymers come from the groups of the quaternized cellulose derivatives, the polysiloxanes with quaternary groups, the cationic guar derivatives, the polymeric dimethyldiallylammonium salts and the copolymers thereof with esters and amides of acrylic acid and methacrylic acid, the copolymers of vinylpyrrolidone with quaternized derivatives of dialkylaminoacrylate and -methacrylate, the vinylpyrrolidone-methoimidazolium chloride copolymers, the quaternized polyvinyl alcohols or the polymers specified under the INCI names Polyquaternium 2, Polyquaternium 17, Polyquaternium 18 and Polyquaternium 27.

"Amphoteric polymers" in the context of the present invention have, as well as a positively charged group, additionally also negatively charged groups or monomer units in the polymer chain.

These groups may, for example, be carboxylic acids, sulphonic acids or phosphonic acids. Polymers suitable as additives are especially maleic acid-acrylic acid copolymer sodium salt (for example Sokalan® CP 5 from BASF, Ludwigshafen (Germany)), modified polyacrylic acid sodium salt (for example Sokalan® CP 10 from BASF, Ludwigshafen (Germany)), modified polycarboxylate sodium salt (for example Sokalan® HP 25 from BASF, Ludwigshafen (Germany)), polyalkylene oxide-modified heptamethyltrisiloxane (for example Silwet® L-77 from BASF, Ludwigshafen (Germany)), polyalkylene oxide-modified heptamethyltrisiloxane (for example Silwet® L-7608 from BASF, Ludwigshafen (Germany)) and polyethersiloxanes (copolymers of polymethylsiloxanes with ethylene oxide/propylene oxide segments (polyether blocks)), preferably water-soluble linear polyethersiloxanes having terminal polyether blocks, such as Tegopren® 5840, Tegopren® 5843, Tegopren® 5847, Tegopren® 5851, Tegopren® 5863 or Tegopren® 5878 from Evonik Industries AG, Essen (Germany). However, the use of Tegopren products 5843 and 5863 is less preferable in the case of use on hard surfaces made from glass, especially glassware, since these silicone surfactants can attack glass. In a particular embodiment of the invention, the additives mentioned are dispensed with.

Preferred embodiments of the formulations according to the invention further comprise a bleach, especially an oxygen bleach, and optionally a bleach activator and/or bleach catalyst. A preferred bleach present in formulations according to the invention is an oxygen bleach from the group of sodium percarbonate, sodium perborate tetrahydrate and sodium perborate monohydrate. Further usable bleaches are, for example, peroxypyrophosphates, citrate perhydrates and $H_2O_2$-supplying peracidic salts or peracids, such as perbenzoates, peroxophthalates, diperazelaic acid, phthalimino peracid or diperdodecanedioic acid. In addition, it is also possible to use bleaches from the group of the organic bleaches. Typical organic bleaches are the diacyl peroxides, for example dibenzoyl peroxide. Further typical organic bleaches are the peroxy acids, particular examples cited being the alkyl peroxy acids and the aryl peroxy acids. Owing to its good bleaching performance, sodium percarbonate is particularly preferred. A particularly preferred oxygen bleach is sodium percarbonate.

Bleaches used may also be chlorine- or bromine-releasing substances. Among the suitable chlorine- or bromine-releasing materials, examples of useful materials include heterocyclic N-bromo- and N-chloroamides, for example trichloroisocyanuric acid, tribromoisocyanuric acid, dibromoisocyanuric acid and/or dichloroisocyanuric acid (DICH) and/or the salts thereof with cations such as potassium and sodium. Hydantoin compounds, such as 1,3-dichloro-5,5-dimethylhydantoin, are likewise suitable.

Bleach activators used may be compounds which, under perhydrolysis conditions, give aliphatic peroxocarboxylic acids having preferably 1 to 10 carbon atoms, especially 2 to 4 carbon atoms, and/or optionally substituted perbenzoic acid. Suitable substances are those which bear O- and/or N-acyl groups of the stated number of carbon atoms and/or optionally substituted benzoyl groups. Preference is given to polyacylated alkylenediamines, and tetraacetylethylenediamine (TAED) has been found to be particularly suitable.

The bleach catalysts are bleach-boosting transition metal salts or transition metal complexes, for example Mn-, Fe-, Co-, Ru- or Mo-salen complexes or -carbonyl complexes. Also usable as bleach catalysts are Mn, Fe, Co, Ru, Mo, Ti, V and Cu complexes with N-containing tripod ligands and Co-, Fe-, Cu- and Ru-ammine complexes. With particular preference, complexes of manganese in the II, III, IV or V oxidation state are used, preferably containing one or more macrocyclic ligand(s) with the donor functions N, NR, PR, O and/or S. Preference is given to using ligands having nitrogen donor functions. It is particularly preferable to use bleach catalyst(s) in the formulations according to the invention that contain, as macromolecular ligands, 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1-1,4,7-trimethyl-1,4,7-triazacyclononane (Me/Me-TACN) and/or 2-methyl-1,4,7-triazacyclononane (Me/TACN). Suitable manganese complexes are, for example, $[Mn^{III}2(\mu\text{-}O)_1(\mu\text{-}OAc)_2(TACN)_2](ClO_4)_2$, $[Mn^{III}Mn^{IV}(\mu\text{-}O)_2(\mu\text{-}OAc)_1(TACN)_2](BPh_4)_2$, $[Mn^{IV}4(\mu\text{-}O)_6(TACN)_4](ClO_4)_4$, $[Mn^{III}2(\mu\text{-}O)_1(\mu\text{-}OAc)_2(Me\text{-}TACN)_2](ClO_4)_2$, $[Mn^{III}Mn^{IV}(\mu\text{-}O)_1(\mu\text{-}OAc)_2(Me\text{-}TACN)_2](ClO_4)_3$, $[Mn^{IV}{}_2(\mu\text{-}O)_3(Me\text{-}TACN)_2](PF_6)_2$ and $[Mn^{IV}{}_2(\mu\text{-}O)_3(Me/Me\text{-}TACN)_2](PF_6)_2$ (with OAc═OC(O)$CH_3$).

As well as the complexes mentioned so far, the formulations according to the invention may comprise further customary auxiliaries and additives. These include, for example, additives, dyes, preservatives (for example 2-bromo-2-nitropropane-1,3-diol (CAS 52-51-7), also referred to in industry as bronopol, commercially available, for example, as Myacide® BT or as Boots Bronopol BT from Boots, these may be present in amounts of typically not more than 1% by weight.

In addition, the formulations according to the invention may comprise glass corrosion inhibitors which prevent the occurrence of cloudiness, streaks and scratches, but also the iridescence of the glass surface of machine-cleaned glasses.

Preferred glass corrosion inhibitors come from the group of the magnesium and zinc salts and the magnesium and zinc complexes. Formulations according to the invention may, in a preferred embodiment, comprise at least one zinc salt as a further constituent. The zinc salt here may be an inorganic or organic zinc salt. The inorganic zinc salt is preferably selected from the group consisting of zinc bromide, zinc chloride, zinc iodide, zinc nitrate and zinc sulphate. The organic zinc salt is preferably selected from the group consisting of zinc salts of monomeric or polymeric organic acids, especially from the group of zinc acetate, zinc acetylacetonate, zinc benzoate, zinc formate, zinc lactate, zinc gluconate, zinc ricinoleate, zinc abietate, zinc valerate and zinc p-toluenesulphonate. In an embodiment which is particularly preferred in accordance with the invention, the zinc salt used is zinc acetate. The content of zinc salt in the formulations is preferably between 0% and 5% by weight, preferably between 0.1% and 4% by weight and especially between 0.4% and 3% by weight, or the content of zinc in oxidized form (calculated as $Zn^{2+}$) is between 0% and 1% by weight, preferably between 0.01 b and is 0.5% by weight and especially between 0.02% and 0.2% by weight, based in each case on the total weight of the glass corrosion inhibitor-containing composition.

The machine dishwashing detergents according to the invention are preferably in the form of a shaped body, especially a compactate, in particular a tablet. However, they may also be present in combination with other supply forms, especially in combination with solid supply forms such as powders, granules or extrudates, or in combination with liquid supply forms based on water and/or organic solvents. The shaped body may, for example, also be a granular material present in a pouch or a casting mould.

In order to facilitate the breakdown of such prefabricated shaped bodies, it is possible to incorporate disintegration aids, called tablet disintegrants, into these formulations, in order to shorten the breakdown times. Tablet disintegrants or breakdown accelerators are understood to be auxiliaries which ensure the rapid breakdown of tablets in water or other media and the rapid release of the active ingredients. Preferably, disintegration aids may be used in amounts of 0.5% to 10% by weight, preferably 3% to 7% by weight and especially 4% to 6% by weight, based in each case on the total weight of the disintegration aid-containing formulation.

Formulations according to the invention may be formulated as single-phase or multiphase products. Preference is given especially to machine dishwashing detergents having one, two, three or four phases. Particular preference is given to machine dishwashing detergents, characterized in that they are in the form of a prefabricated dosage unit having two or more phases. Particular preference is given especially to bi- or polyphasic tablets, for example bilayer tablets, especially bilayer tablets with a recess and a shaped body present in the recess.

Formulations according to the invention are preferably preformulated to give dosage units. These dosage units preferably comprise the amount of washing- or cleaning-active substances necessary for a cleaning cycle. Preferred dosage units have a weight between 12 and 30 g, preferably between 14 and 26 g and especially between 15 and 22 g. The volume of the aforementioned dosage units and the three-dimensional shape thereof are chosen with particular preference such that dosability of the preformulated units via the dosage chamber of a machine dishwasher is assured. The volume of the dosage unit is therefore preferably between 10 and 35 ml, preferably between 12 and 30 ml and especially between 15 and 25 ml.

The formulations according to the invention, especially the preformulated dosage units, in a preferred embodiment, have a water-soluble envelope.

The water-soluble envelope is preferably formed from a water-soluble film material selected from the group consisting of polymers and polymer mixtures. The envelope may be formed from one or two or more layers of the water-soluble film material. The water-soluble film material of the first layer and the further layers, if present, may be the same or different. Particular preference is given to films which can be bonded and/or sealed, for example, to give packages such as tubes or cushions after they have been filled with a composition.

It is preferable that the water-soluble envelope comprises polyvinyl alcohol or a polyvinyl alcohol copolymer. Water-soluble envelopes comprising polyvinyl alcohol or a polyvinyl alcohol copolymer have good stability coupled with sufficiently high water solubility, especially cold water solubility.

Suitable water-soluble films for production of the water-soluble envelope are preferably based on a polyvinyl alcohol or a polyvinyl alcohol copolymer having a molecular weight in the range from 10 000 to 1 000 000 $gmol^{-1}$, preferably from 20 000 to 500 000 $gmol^{-1}$, more preferably from 30 000 to 100 000 $gmol^{-1}$ and especially from 40 000 to 80 000 $gmol^{-1}$.

The preparation of polyvinyl alcohol is typically accomplished by hydrolysis of polyvinyl acetate, since the direct synthesis route is not possible. The same applies to polyvinyl alcohol copolymers, which are prepared correspondingly from polyvinyl acetate copolymers. It is preferable when at least one layer of the water-soluble envelope comprises a polyvinyl alcohol having a hydrolysis level that amounts to 70 to 100 mol %, preferably 80 to 90 mol %, more preferably 81 to 89 mol % and especially 82 to 88 mol %.

A polyvinyl-alcohol containing film material suitable for production of a water-soluble envelope may additionally be supplemented with a polymer selected from the group comprising (meth)acrylic acid-containing (co)polymers, polyacrylamides, oxazoline polymers, polystyrenesulphonates, polyurethanes, polyesters, polyethers, polylactic acid or mixtures of the above polymers. A preferred additional polymer is polylactic acids.

Preferred polyvinyl alcohols comprise, as well as vinyl alcohol, dicarboxylic acids as further monomers. Suitable dicarboxylic acids are itaconic acid, malonic acid, succinic acid and mixtures thereof, preference being given to itaconic acid.

Polyvinyl alcohol copolymers that are likewise preferred comprise, as well as vinyl alcohol, an ethylenically unsaturated carboxylic acid, salt thereof or ester thereof. More preferably, such polyvinyl alcohol copolymers contain, as well as vinyl alcohol, acrylic acid, methacrylic acid, acrylic esters, methacrylic esters or mixtures thereof.

It may be preferable that the film material comprises further additions. The film material may comprise, for example, plasticizers such as dipropylene glycol, ethylene glycol, diethylene glycol, propylene glycol, glycerol, sorbitol, mannitol or mixtures thereof. Further additions include, for example, release aids, fillers, crosslinkers, surfactants, antioxidants, UV absorbers, antiblocking agents, antisticking agents or mixtures thereof.

Suitable water soluble films for use in the water-soluble envelopes of the water-soluble packages according to the invention are films sold by MonoSol LLC, for example under the M8630, C8400 or M8900 name. Other suitable films include films having the Solublon® PT, Solublon®

GA, Solublon® KC or Solublon® KL name from Aicello Chemical Europe GmbH or the VF-HP films from Kuraray.

The present invention further provides for the use of a formulation according to the invention for employment in a machine dishwashing method.

The present invention further still provides for the use of a formulation according to the invention for cleaning of hard surfaces, especially for removal of starchy stains.

In the aforementioned uses according to the invention, preference is given to using formulations according to the invention that are emphasized as preferred above.

The examples adduced hereinafter describe the present invention by way of example, without any intention that the invention, the scope of application of which is apparent from the entirety of the description and the claims, be restricted to the embodiments specified in the examples.

EXAMPLES

The sophorolipid used is a sophorolipid obtained by fermentation from rapeseed oil and sugar. The content of free fatty acids is less than 1% by weight, based on the amount of sophorolipid present. The sophorolipid used has a ratio of sophorolipid acid to sophorolipid lactone of 60:40. The loading of the supports with sophorolipid was calculated as follows: mass of the sophorolipid used divided by mass of the dried granular material.

Example 1: Sodium Percarbonate as Support

An AEROMATIC Strea 1 fluidized bed laboratory coater was initially charged with 980 g of Q 30 sodium percarbonate (trade name of Evonik Industries AG), and the air rate was adjusted such that the sodium percarbonate was fluidized. As soon as the temperature of the fluidized sodium percarbonate was between 55° C. and 60° C., the dosage of the sophorolipid solution (18.5 g of sophorolipid dissolved in 150 g of water) was started and the dosage rate was adjusted such that the temperature was between 50° C. and 60° C. over the entire period. After the entire solution had been applied, the product was dried at a temperature of 80° C. for 10 min and, for avoidance of caking, a sodium sulphate layer is sprayed on (50 g of 6% by weight sodium sulphate solution, temperature during coating: 50-55° C., drying at 80° C. for 5 min). 1001.5 g of granular material were obtained. The loading with sophorolipid (active substance) was 1.8%.

Example 2: Precipitated Silica as Support

A Lödige 51 ploughshare mixer was initially charged with 3 kg of Sipernat® 22 (Evonik Ressource Efficiency GmbH) and, at a speed of the mixer head of 700 scale divisions, 1.7 kg dissolved in 3 kg of water were sprayed on. Subsequently, the powder was sieved, which removed fractions having a particle size >0.4 mm.

The loading with sophorolipid active substance was 43%.

Example 3: Sodium Carbonate as Support

A Lödige 5 l ploughshare mixer was initially charged with 2.4 kg of sodium carbonate from Solvay with a particle size of >0.3 mm and a bulk density of 500-600 kg/m$^3$ and, at a speed of the mixer head of 700 scale divisions, 177 g of sophorolipid dissolved in 303 g of water were sprayed on. Subsequently, the material was dried at room temperature and comminuted to particles having a particle size in the range of 300-1600 μm. The loading with sophorolipid active substance was: 8.6% by weight.

Test Method for Determination of Cleaning Performance

The cleaning performance of the machine dishwashing detergents was determined by the current IKW method (SÖFW, 132 (March 2006) 55 ff.) using the modified stains described in the aforementioned reference with improved differentiation. The studies were conducted at a water hardness of 9±1° dH in a domestic Miele GSL2 machine dishwasher using the "R45° C./8 min/K155° C." program in the presence of ballast soil and with the water softener deactivated. The maximum temperature during the cleaning phase was 45° C. Each test run was conducted in the presence of 50 g of ballast soil. The ballast soil was produced by the IKW method. The dosage was effected at the start of the main wash cycle. The stains tested can be found in Table 1 below.

TABLE 1

| Stains tested: | | |
|---|---|---|
| Stain | Carrier | Soil class |
| Tea | Porcelain cup | Bleach-sensitive |
| Milk | Glass beaker | Alkali-sensitive |
| Mince | Dessert plate, porcelain | Protease-sensitive |
| Egg yolk | Stainless steel sheets | Protease-sensitive |
| Crème brûlée | Dessert plate, porcelain | Protease-sensitive |
| Starch | Glass plate | Amylase-sensitive |
| Pasta | Plate, porcelain | Amylase-sensitive |

In accordance with the IKW method, 6 parts of each stain type were distributed in a typical domestic manner in the machine dishwasher. The results for the cleaning performance are the mean values from four repetitions for each formulation. For each cleaning job, 20 g of the machine dishwashing detergent were used.

The cleaning performance was assessed either by gravimetric or visual means and assessed by a performance index scale from 0 (no cleaning) to 100 (complete cleaning).

TABLE 2

| Formulations | | | | | | |
|---|---|---|---|---|---|---|
| Raw materials | A | B | C | D | E | F |
| Sodium citrate 2 $H_2O$ | 39.7% | 35% | 39.4% | 39.7% | 39.7% | 35% |
| Sodium carbonate | 18.8% | 13.5% | 18.8% | 14.5% | 18.8% | 13.5% |
| Trilon ® M granules [1)] | 15% | 15% | 15% | 15% | 15% | 15% |
| Sodium percarbonate | 14% | 14% | 13.7% | 14% | 0% | 14% |
| Sokolan ® CP 50 granules [2)] | 6.5% | 6.5% | 6.5% | 6.5% | 6.5% | 6.5% |
| TAED [3)] | 4% | 4% | 4% | 4% | 4% | 4% |
| Sodium disilicate | 2% | 2% | 2% | 2% | 2% | 2% |
| Unsupported sophorolipid | 0% | 0% | 0.3% | 4.3% | 0% | 0% |
| Sipernat ® 22 without sophorolipid | 0% | 10% | 0% | 0% | 0% | 0% |

TABLE 2-continued

| Raw materials | Formulations | | | | | |
|---|---|---|---|---|---|---|
| | A | B | C | D | E | F |
| Sophorolipid on Sipernat ® 22 (from Example 2) | 0% | 0% | 0% | 0% | 0% | 10% |
| Sodium percarbonate coated with sophorolipid (from Example 1) | 0% | 0% | 0% | 0% | 14% | 0% |

[1] Trisodium methylglycinediacetate (MGDA-Na3) (trade name of BASF SE)
[2] Trade name of BASF SE
[3] Tetraacetylethylenediamine Formulation A, being a noninventive formulation, contains neither sophorolipid nor Sipemat® 22.

Formulation B, being a noninventive formulation, contains Sipemat® 22 and neither supported nor free sophorolipid.

The noninventive formulation C contains a 0.3% active content of unsupported sophorolipid.

The noninventive formulation D contains a 4.3% active content of unsupported sophorolipid.

The active content of sophorolipid in the inventive formulation E is 0.3% by weight, and in the inventive formulation F is 4.3% by weight.

As a further noninventive reference substance, a commercial automatic machine dishwasher powder of the Finish Classic powder brand from Reckitt Benckiser was used. The qualitative composition of Finish Classic powder, according to the detergents legislation in descending sequence, is sodium carbonate, sodium percarbonate, sodium citrate, TAED, sodium polyacrylates, subtilisin (protease), tetrasodium etidronate fatty alcohol ethoxylate, amylase, perfume. The commercial product thus contains the starch-degrading enzyme amylase.

TABLE 3

Cleaning performance with respect to the starchy stains starch and pasta (scale from 0 (no cleaning) to 100 (complete cleaning))

| Formulation | Cleaning index | |
|---|---|---|
| | Pasta | Starch |
| Finish Classic Powder (reference - noninventive) | 42 | 64 |
| A (noninventive) | 23 | 35 |
| B (noninventive) | 23 | 35 |
| C (noninventive) | 22 | 31 |
| D (noninventive) | 25 | 35 |
| E (inventive) | 30 | 55 |
| F (inventive) | 23 | 74 |

It is clearly apparent that the amylase-containing commercial product Finish Classic powder has good cleaning performance on starch and pasta stains.

The noninventive formulation A without enzymes shows significantly poorer cleaning performance. The addition of Sipemat® 22 to the formulation does not give any improvement in cleaning performance. Even the addition of unsupported sophorolipid, as in formulations C and D, does not cause any apparent improvement in cleaning performance.

The inventive formulation E, comprising sophorolipid-coated sodium percarbonate, shows a distinct improvement in cleaning action compared to formulations A and C.

The inventive formulation F, comprising sophorolipid supported on precipitated silica (Sipernat® 22), exhibits a significant improvement in cleaning action in relation to the starch stain compared to formulations B and D. More particularly, formulation F shows surprising better removal of the starch stain than the reference Finish Classic powder containing the starch-degrading enzyme amylase.

Example 4: Precipitated Silica as Support with Defoamer

A Lödige 51 ploughshare mixer was initially charged with 3 kg of Sipernat® 22 (Evonik Ressource Efficiency GmbH) and, at a mixer head speed of 700 scale divisions, 8.5 g of Tego Antifoam KS 53 and 1.7 kg of sophorolipid dissolved in 3 kg of water were sprayed in. Subsequently, the powder was sieved, which resulted in removal of fractions having a grain size of >0.4 mm.

The loading with sophorolipid active substance was 43%.

Example 5: Sodium Carbonate as Support with Defoamer

A Lödige 5 l ploughshare mixer was initially charged with 2.5 kg of sodium carbonate from Solvay with a grain size of >0.3 mm and a bulk density of 500-600 kg/m$^3$ and, at a mixer head speed of 700 scale divisions, 2.5 g of Tego Antifoam KS 53 and 420 g of sophorolipid dissolved in 513 g of water were sprayed in. Subsequently, the material was dried at room temperature and comminuted to particles having a particle size in the range of 300-1600 μm. The loading with sophorolipid active substance was: 14.3% by weight.

Example 6: Sodium Carbonate as Support with Defoamer 2

A Lödige 5 l ploughshare mixer was initially charged with 2.5 kg of sodium carbonate from Solvay with a grain size of >0.3 mm and a bulk density of 500-600 kg/m$^3$ and, at a mixer head speed of 700 scale divisions, 2.5 g of Tego Antifoam WM 20 and 445.9 g of sophorolipid dissolved in 485.1 g of water were sprayed in. Subsequently, the material was dried at room temperature and comminuted to particles having a particle size in the range of 300-1600 μm. The loading with sophorolipid active substance was: 15% by weight.

Example 7: Defoaming Characteristics

For the ADW (automatic dishwash) application, it is essential that the formulations and the corresponding formulation constituents have zero foaming or only very weak foaming.

Testing of the Foam Properties:

Test Setup 100 ml screwtop cylinder 0.1% solution in deionized water of, for example, example 5 transfer 50 ml from the solution in the 100 ml cylinder shake cylinder 20× after it has been screwed shut the foam height is measured directly after shaking, then after 10 seconds, 30 seconds, 45 seconds, 1 minute and 2 minutes (see table)

Results:

| | Foam height for Example 3 [cm] | Foam height for Example 5 [cm] | Foam height for Example 6 [cm] |
|---|---|---|---|
| Directly after | 100 | 85 | 70 |
| After 15 sec | 97 | 65 | No foam visible any more |
| After 30 sec | 95 | No foam visible any more | No foam visible any more |
| After 1 min | 80 | No foam visible any more | No foam visible any more |
| After 2 min | 55 | No foam visible any more | No foam visible any more |

The effect of the addition of very small amounts of defoamer to the granular sophorolipid material is that the product has very low foaming and the resultant foam collapses within a very short time.

The invention claimed is:

1. A dishwashing detergent granular material comprising an inorganic solid support on which at least one biosurfactant is coated on the inorganic support in the amount of from 0.01% by weight to 70% by weight wherein the percentages by weight are based on the sum total of the weights of biosurfactant and inorganic solid support, wherein the at least one biosurfactant is a sophorolipid, wherein the sophorolipid is present in lactone form and acid form, in which the weight ratio of the lactone form to the acid form is within a range from 20:80 to 80:20, wherein the inorganic solid support comprises from 40% to 100% by weight based on the overall inorganic solid support of at least one solid material selected from the group consisting of carbonates, sesquicarbonates, percarbonates, perborates, sulphates, silicates, aluminosilicates, zeolites, precipitated silicas and fumed silicas;

from 0.05% by weight to 0.5% by weight, wherein the percentages by weight are based on the sum total of the weights of the biosurfactant, defoamer and support, of a defoamer selected from the group consisting of vegetable oils, colza oil, rapeseed oil, silicone oils, hydrophobized silica, paraffins, paraffin-alcohol combinations, bis-fatty acid amides and polyorganosiloxanes;

wherein the dishwashing detergent granular material has a median particle size of d50 in the range of from 100 to 2000 μm and has a d10 value that is not less than 50% and a d90 value that is not greater than 150% of the median particle size d50.

2. The dishwashing detergent granular material according to claim 1, wherein the carbonates, percarbonates, and sulphates are salts of the alkali metals or alkaline earth metals, and wherein the inorganic solid support comprises from 50% to 90% by weight based on the overall inorganic solid support, and wherein the dishwashing detergent granular material is formed into a tablet.

3. The dishwashing detergent granular material according to claim 2, wherein the at least one solid material is selected from the group consisting of sodium carbonate, sodium percarbonate, precipitated silicas and fumed silicas.

4. The dishwashing detergent granular material according to claim 2, wherein the weight ratio of the lactone form to the acid form is within a range from 30:70 to 40:60.

5. The dishwashing detergent granular material according to claim 1, wherein the at least one solid material is selected from the group consisting of sodium carbonate, sodium percarbonate, precipitated silicas and fumed silicas, and wherein the inorganic solid support comprises from 60% to 80% by weight based on the overall inorganic solid support.

6. The dishwashing detergent granular material according to claim 5, wherein the weight ratio of the lactone form to the acid form is within a range from 30:70 to 40:60.

7. The dishwashing detergent granular material according to claim 1, wherein the weight ratio of the lactone form to the acid form is within a range of from 30:70 to 40:60.

8. The dishwashing detergent granular material according to claim 1, wherein the biosurfactant is coated on the support in an amount of from 0.25% by weight to 60% by weight, where the percentages by weight are based on the sum total of the weights of biosurfactant and support.

9. The dishwashing detergent granular material according to claim 1, wherein the biosurfactant is coated on the support in an amount of from 1.5% by weight to 50% by weight, where the percentages by weight are based on the sum total of the weights of biosurfactant and support.

10. A formulation comprising the granular material according to claim 1, wherein the formulation contains from 0.1% by weight to 60% by weight, of the granular material, where the percentages by weight are based on the overall formulation.

11. A formulation according to claim 10, wherein the formulation comprises at least one further constituent selected from the group consisting of builders, surfactants, polymers, corrosion inhibitors, glass corrosion inhibitors, disintegration aids, enzymes, bleaches, bleach catalysts, bleach activators, fragrances and perfume carriers.

12. A formulation according to claim 10, wherein the formulation comprises at least two further constituents, selected from the group consisting of builders, surfactants, polymers, corrosion inhibitors, glass corrosion inhibitors, disintegration aids, enzymes, bleaches, bleach catalysts, bleach activators, fragrances and perfume carriers.

13. A formulation according to claim 10, wherein the formulation is a cleaning composition for a dishwashing detergent for machine cleaning of dishware.

14. A formulation according to claim 10 for employment in a machine dishwashing method.

15. A formulation according to claim 10 for cleaning of hard surfaces, for removal of starchy stains.

16. A process for producing a dishwashing detergent granular material according to claim 1, comprising the process steps of A) providing the inorganic solid support, B) providing the at least one biosurfactant in the form of an aqueous composition which is liquid at 25° C. and 1 bar, C) contacting the support from process step A) with the aqueous composition from process step B) and D) at least partly removing the water originating from the aqueous composition from process step B).

17. The process according to claim 16, wherein, in process step C), the contacting is effected by spraying the aqueous composition from process step B) onto the support from process step A).

* * * * *